US008662906B2

(12) United States Patent
Schmitt et al.

(10) Patent No.: US 8,662,906 B2
(45) Date of Patent: Mar. 4, 2014

(54) PLUG-AND-SOCKET CONNECTOR WITH A BLOCKING ELEMENT

(75) Inventors: Marcel Schmitt, Gorxheimertal (DE); Richard Forell, Lorsch (DE); Joachim Schneider, Einhausen (DE)

(73) Assignee: Tyco Electronics AMP GmbH, Bensheim (DE)

( * ) Notice: Subject to any disclaimer, the term of this patent is extended or adjusted under 35 U.S.C. 154(b) by 25 days.

(21) Appl. No.: 13/383,811

(22) PCT Filed: Jul. 8, 2010

(86) PCT No.: PCT/EP2010/059793
§ 371 (c)(1), (2), (4) Date: Jan. 12, 2012

(87) PCT Pub. No.: WO2011/006821
PCT Pub. Date: Jan. 20, 2011

(65) Prior Publication Data

US 2012/0115342 A1 May 10, 2012

(30) Foreign Application Priority Data

Jul. 13, 2009 (DE) ..... 10 2009 027 660

(51) Int. Cl.
*H01R 13/62* (2006.01)

(52) U.S. Cl.
USPC ..... 439/157; 439/372

(58) Field of Classification Search
USPC ..... 439/157, 372
See application file for complete search history.

(56) References Cited

U.S. PATENT DOCUMENTS

| | | | | |
|---|---|---|---|---|
| 6,540,532 | B1 * | 4/2003 | Martin et al. | 439/157 |
| 6,558,176 | B1 * | 5/2003 | Martin et al. | 439/157 |
| 6,767,231 | B1 * | 7/2004 | Martin et al. | 439/157 |
| 7,445,475 | B2 | 11/2008 | Tajiri et al. | |
| 8,197,270 | B2 * | 6/2012 | Vasbinder et al. | 439/157 |
| 8,414,315 | B2 * | 4/2013 | Dekoski | 439/157 |
| 2007/0197074 | A1 * | 8/2007 | Gimbel et al. | 439/213 |

FOREIGN PATENT DOCUMENTS

| | | |
|---|---|---|
| EP | 1887664 A1 | 2/2008 |
| GB | 2446716 B | 8/2008 |

OTHER PUBLICATIONS

International Preliminary Report on Patentability, issued by the International Bureau of WIPO, Geneva, Switzerland, dated Jan. 17, 2012, for International PCT Application No. PCT/EP2010/059793; 7 pages.

International Search Report and the Written Opinion issued by the European Patent Office, Rijswijk, Netherlands, dated Sep. 23, 2010, for related International Application No. PCT/EP2010/059793; 13 pages.

Search Report issued by the German Patent and Trademark Office, Munich, Germany, dated Mar. 12, 2010, for Priority Application No. DE102009027660.2; 5 pages.

* cited by examiner

*Primary Examiner* — Hae Moon Hyeon
(74) *Attorney, Agent, or Firm* — Faegre Baker Daniels LLP

(57) ABSTRACT

The invention relates to a plug-and-socket connector with a first housing with first electrical contacts and a second housing with second electrical contacts. The first housing has a lever and a blocking element. The second housing has a toothed surface on which the lever arm can be brought into contact with an actuating surface upon pivoting in order to draw the first and the second housing together into an end position in which the first and the second contacts are contacted with each other.

12 Claims, 8 Drawing Sheets

PLUG-AND-SOCKET CONNECTOR WITH A BLOCKING ELEMENT

THE BACKGROUND OF THE INVENTION

The invention relates to a plug-and-socket connector in accordance with patent claim 1 and a first housing in accordance with patent claim 12.

Many and varied embodiments of plug-and-socket connectors are known from the prior art: a plug-and-socket connector can have two housings with contacts, which can be drawn together from a pre-assembly position into an end position via a lever arm rotatably mounted on a housing.

A hybrid connector system with a first and a second housing, in which a pivotable stirrup part which by pivoting assembles the two housings more deeply together is provided, is known from Tyco Electronics. The pivotable stirrup part is rotatably mounted on the first housing. A blocking element is provided on the second housing, which element prevents the stirrup part from pivoting in a pre-assembly position and releases only when the two housings are assembled more deeply together into the assembly position.

SUMMARY OF THE INVENTION

The object of the invention is to provide an improved plug-and-socket connector with a lever in which the drawing-together of the two housings is reliably carried out.

The object of the invention is achieved by the plug-and-socket connector in accordance with patent claim 1 and the first housing in accordance with patent claim 12.

Further advantageous embodiments of the plug-and-socket connector are set forth in the dependent claims.

One advantage of the plug-and-socket connector is that the two housings of the plug-and-socket connector can only be brought into the end position with the aid of the lever arm when the two housings have a defined assembly position. The defined assembly position firstly ensures that the lever acts securely and reliably on a defined surface of the second housing. One further advantage of the defined assembly position is that the contacts of the two housings in the assembly position have a defined position relative to one another and, once the two housings have been assembled by the lever, are in a defined end position. This increases the reliability of the electrical contacting between the electrical contacts.

According to the invention, the actuation of the lever from the pre-engagement position into the end position is prevented by a blocking surface. The blocking surface is formed on the first housing and is moved out of a blocking position by an actuating surface of the second housing if the first and the second housing are pushed together into the assembly position. Forming the blocking surface on the same housing on which the lever arm is mounted offers the advantage that accurate matching of the blocking position to the lever is possible. Owing to the accurate matching, it is possible to make both the contact surface of the lever associated with the blocking surface and the blocking surface itself relatively small and to manufacture it with low expense in terms of material. This firstly permits secure operation and secondly an inexpensive configuration of the blocking function.

In one development, the blocking element of the first housing is designed as a flexible tongue which is arranged laterally on a housing wall of the first housing. This provides a space-saving and simple embodiment of the blocking element.

In a further embodiment, the blocking element has a second actuating surface arranged at least partially at a right-angle to the blocking surface, which actuating surface can be brought into an operative connection with a release surface of the second housing which is provided for actuating the blocking element. Thus a blocking element with a simple geometric construction is provided which firstly permits reliable blocking of the lever and secondly can be moved with the aid of simple means.

In a further embodiment, the contact surface of the lever is formed in a cut-out in the lever. This makes possible a space-saving configuration of the plug-and-socket connector, since the blocking element in the pre-engagement position is partially arranged in the cut-out in the lever. Thus the space required is reduced.

In a further embodiment, the second actuating surface is arranged inclined with increasing coverage to the release surface along the direction of movement of the second housing from the pre-assembly position into the assembly position. This permits easy actuation of the blocking element by the release surface.

In a further embodiment, the plug-and-socket connector has a lever arm which is rotatably mounted on the first housing in a bearing, with the lever arm having an at least partially ring-shaped actuating section in the region of the bearing. A cut-out is provided on the actuating section, on which cut-out the contact surface is provided. Thus a simple construction of the lever with a secure blocking function is achieved.

In a further embodiment, the actuating surface is formed on the actuating section, which surface is provided rotatably about the bearing for acting on the toothed surface of the second housing and for drawing the two housings together. In this manner, a robust construction of the lever mechanism is provided.

In a further embodiment, the release surface is formed on an inner side of the second housing. This permits a simple embodiment of the release surface, with in addition the release surface and the blocking element being covered and protected against damage by the second housing.

In a further embodiment, the actuating section has a second cut-out, into which the blocking element in the end position of the two housings and in the end position of the lever engages resiliently at least with a blocking section. In addition, the second housing has a cut-out into which the blocking element engages with the actuating surface partially in the end position. Thus the blocking element is non-loaded in the completely mounted state of the two housings of the plug-and-socket connector. This avoids fatigue of the material, particularly when the housing and the blocking element are made from plastic material.

BRIEF DESCRIPTION OF THE DRAWINGS

The invention will be explained in greater detail below with reference to the figures. These show.

DETAILED DESCRIPTION OF THE DRAWINGS

Figure 1:
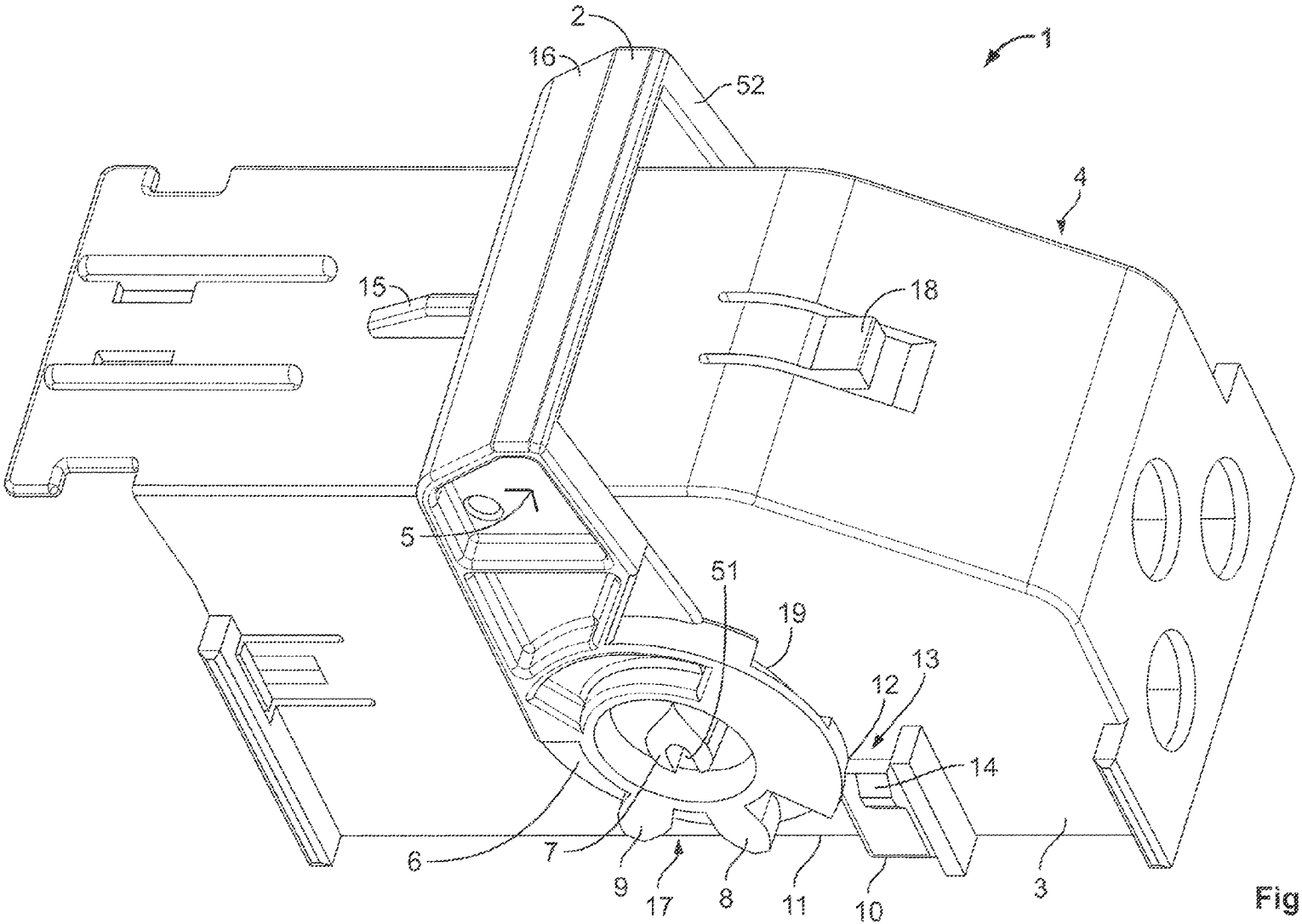
FIG. 1: a perspective view of a first housing of a plug-and-socket connector.

FIG. 1 shows a perspective view of a first housing 1 of a plug-and-socket connector, in which first contacts are arranged. A lever 2 in the form of a U-shaped stirrup part with two lever arms 5, 52 is rotatably mounted on the first housing 1. The lever 2 is mounted on opposing side walls 3, 4 rotatably in end regions of the stirrup arms. The lever 2 has a first actuating section 6 at the end of the lever arm 5. The first actuating section 6 is rotatably mounted on a journal bearing 7 of the first housing 1, the journal bearing 7 being passed through an opening in the annular actuating section 6. The actuating section 6 has two teeth 8, 9, which protrude outwards in the radial direction from an axis of rotation 51 of the first actuating section 6. Furthermore, a blocking element 10 in the form of a tongue is formed on the first side wall 3, which element, starting from a lower edge 11 of the first housing 1, is guided upwards and substantially parallel to the first side wall 3. The blocking element 10 engages with a blocking section 12 in a cut-out 13 in the actuating section 6. The cut-out 13 is formed on an inner side of the first actuating section 6 and faces the first side wall 3. The blocking element 10 has, in addition to the blocking section 12, a nose 14 which is arranged on an outer side of the blocking element 10 and projects away from the first housing 1 outwards out of the blocking element 10. The blocking element 10, by engaging in the cut-out 13, blocks rotation of the lever 2 from the pre-engagement position illustrated, into an end position.

In an anticlockwise direction, a second cut-out 19 is formed above the cut-out 13 on an inner side of the first actuating section 6.

On an upper side of the first housing 1 there is formed a land 15, against which a transverse stirrup part 16 of the lever 2 lies. The land 15 prevents rotation of the lever 2 in an anticlockwise direction. The blocking element 10 prevents rotation of the lever 2 in a clockwise direction.

The first housing 1 has on an underside an insertion side 17, via which electrical contacts of a second housing are inserted into the first housing upon assembling the plug-and-socket connector. Furthermore, the first housing 1 has on the upper side a holding tongue 18 which is provided for engaging the transverse stirrup part 16 in an end position.

Figure 2:
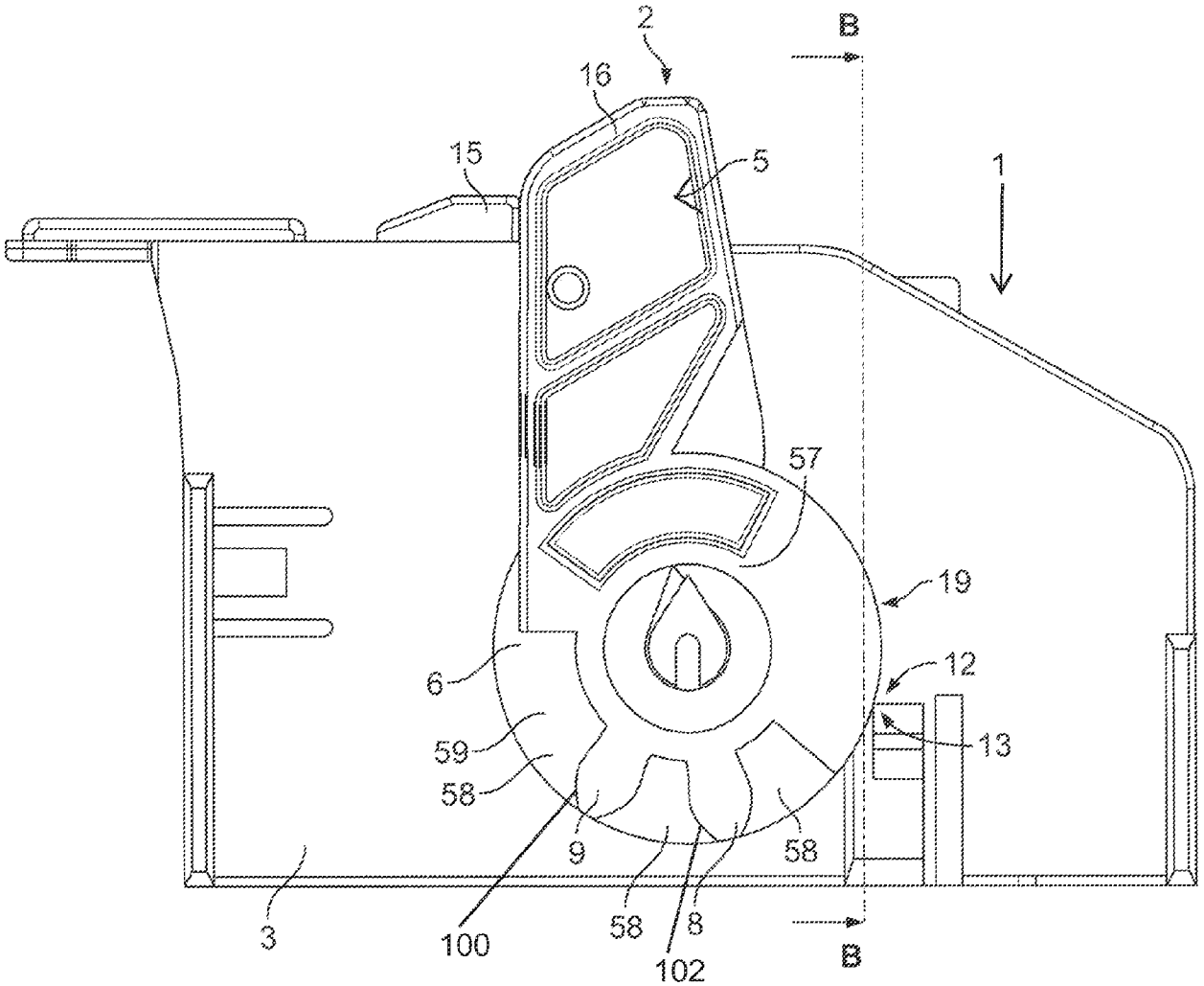
FIG. 2: a side view of the first housing.

FIG. 2 shows a side view of the first side wall 3 of the first housing 1, the lever 2 being in the pre-engagement position. The cut-out 13 and the engagement of the blocking section 12 are represented in broken lines in FIG. 2.

It can clearly be seen from FIG. 2 that the actuating section 6 is in the form of a circular disc, on which the first and the second tooth 8, 9 are formed on an outer side and the first and the second cut-out 13, 19 on a rear side which faces the first side wall 3. The basic form of the actuating section 6 is the disc form, with the first and the second cut-out 13, 19 being formed on the inner side, these being covered on the outer side by a partial ring disc 57. On the outer side there are made additional cut-outs 58, by means of which the teeth 8, 9 are shaped. The additional cut-outs 58 are covered to the inside by a second partial ring disc 59. This achieves a stable actuating section 6 in the form of a ring disc.

Figure 3:
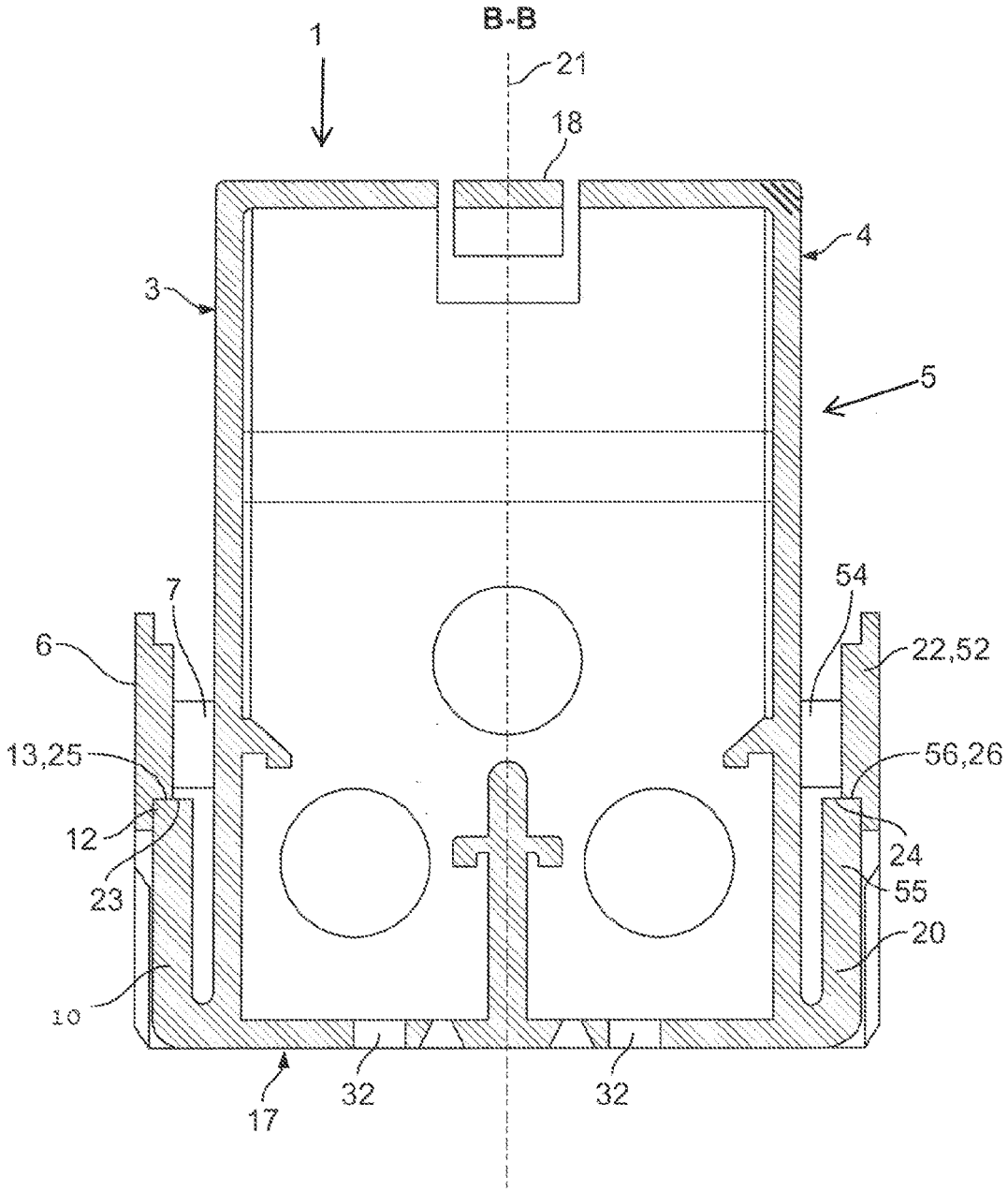
FIG. 3: a cross-section through the first housing.

FIG. 3 shows an enlarged cross-section B-B through the first housing 1 of FIG. 2, the cross-section being taken through the blocking section 12 of the blocking element 10 and the cut-out 13 of the first actuating section 6. The first housing 1 illustrated is formed mirror-symmetrically to a centre line 21, with in each case a first or second blocking element 10, 20 respectively being provided on the opposing side walls 3, 4; in addition, the lever is formed mirror-symmetrically to the centre line 21 and has the first actuating section 6 on the first lever arm 5 and a second actuating section 22 located opposite on the second lever arm 52. The first and the second actuating section 22 are formed identically. Likewise, the first and the second blocking element 10, 20 are formed identically. In the cross-section illustrated, contact holes 32 are shown on the insertion side 17, via which holes the second electrical contacts of the second housing are inserted into the first housing 1 upon assembly of the housing.

The second actuating section 22 is mounted rotatably on the second side wall 4 on a second journal bearing 54. In the position of the lever 2 illustrated, it is not possible to turn the lever 2 in a clockwise direction owing to the blocking sections 12, 55 of the first and the second actuating section 6, 22. The first and the second blocking element 10, 20 have at the upper end one blocking surface 23, 24 in each case. Furthermore, the first and the second actuating section 6, 22 have in the respective cut-out 13, 56 in each case a first and second contact surface 25, 26 which faces the corresponding blocking surface 23, 24 of the blocking elements 10, 20. Upon actuation of the lever 2 in a clockwise direction, the first and the second contact surface 25, 26 are brought to lie against the first and the second blocking surface 23, 24 respectively, so that further turning of the lever 2 is prevented.

The first and the second blocking element 10, 20 are designed as movable tabs which project laterally out of the respective side wall 3, 4 at the lower edge 11 of the first housing 1 and are arranged parallel to the respective side wall 3, 4 substantially vertically to the insertion side 17. Within the first housing 1, first electrical contacts (not shown) are arranged in corresponding contact cavities.

Figure 4:
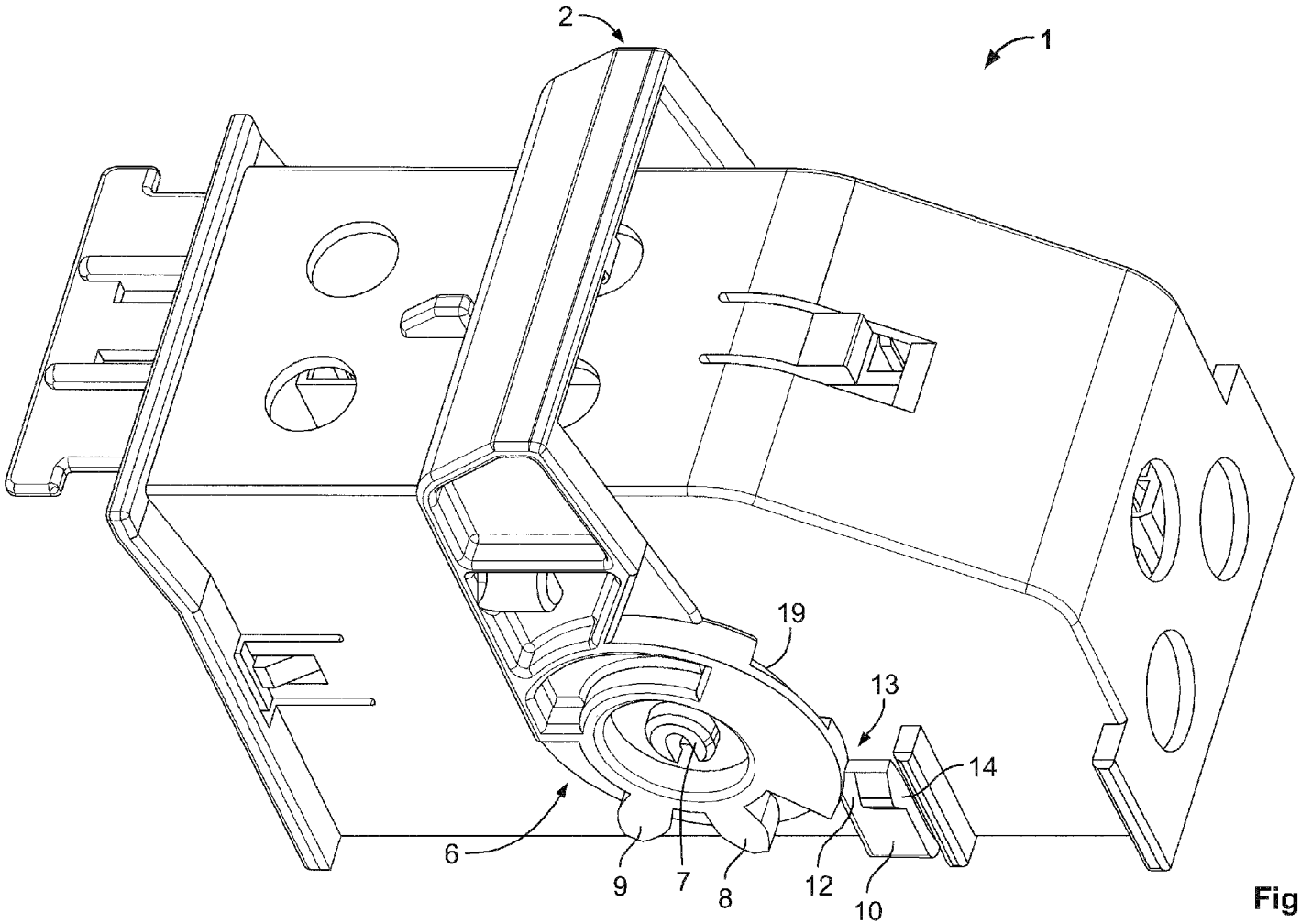
FIG. 4: a further perspective view of the first housing.

FIG. 4 shows in an enlarged perspective partial view the first blocking element 10, which projects into the cut-out 13 in the first actuating section 6. Furthermore, the second cut-out 19, which is formed on an inner side of the first actuating section 6, can clearly be seen in FIG. 4.

Figure 5:
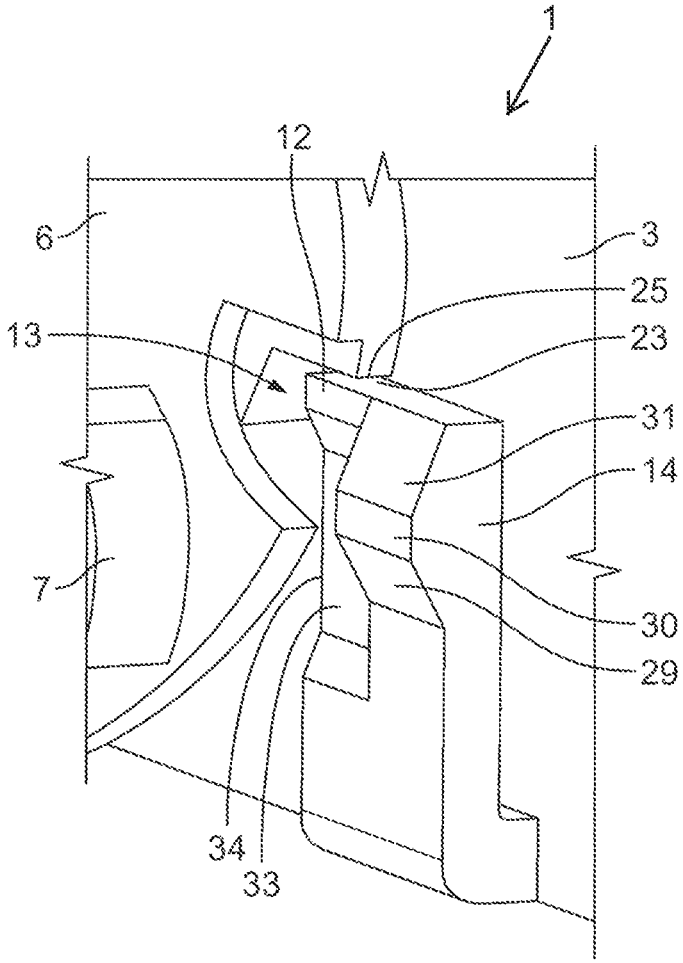
FIG. 5: a partially sectional detail view of the lever arm and the blocking element.

FIG. 5 shows an enlarged partial sectional view of FIG. 4. In FIG. 5, the outer side of the first actuating section 6, for better representation, is shown opened up via a cut-out section. The first blocking element 10 has on an outer side, which is arranged substantially parallel to the first side wall 3, the nose 14 which, coming from below, has a first inclined surface 29, which is arranged leading away outwards from the first housing 1 and merges into a plateau 30. A second inclined surface 31, which is inclined towards the first side wall 3, adjoins the plateau 30 at the top in the direction of the end of the first blocking element 10. In the region of the upper end of the blocking element 10, the blocking element 10 has the same thickness above the nose 14 as it does below the nose 14. Laterally to the nose 14 there is formed the blocking section 12, on which a recess 33 is formed. The recess 33 is formed spaced apart somewhat from the first blocking surface 23 on the outer side of the blocking element 10 and extends laterally to the nose downwards in the direction of the insertion side 17 to beyond the level of the first inclined surface 29. The recess 33 is carried as far as a lateral edge 34 of the blocking element 10.

Figure 6:
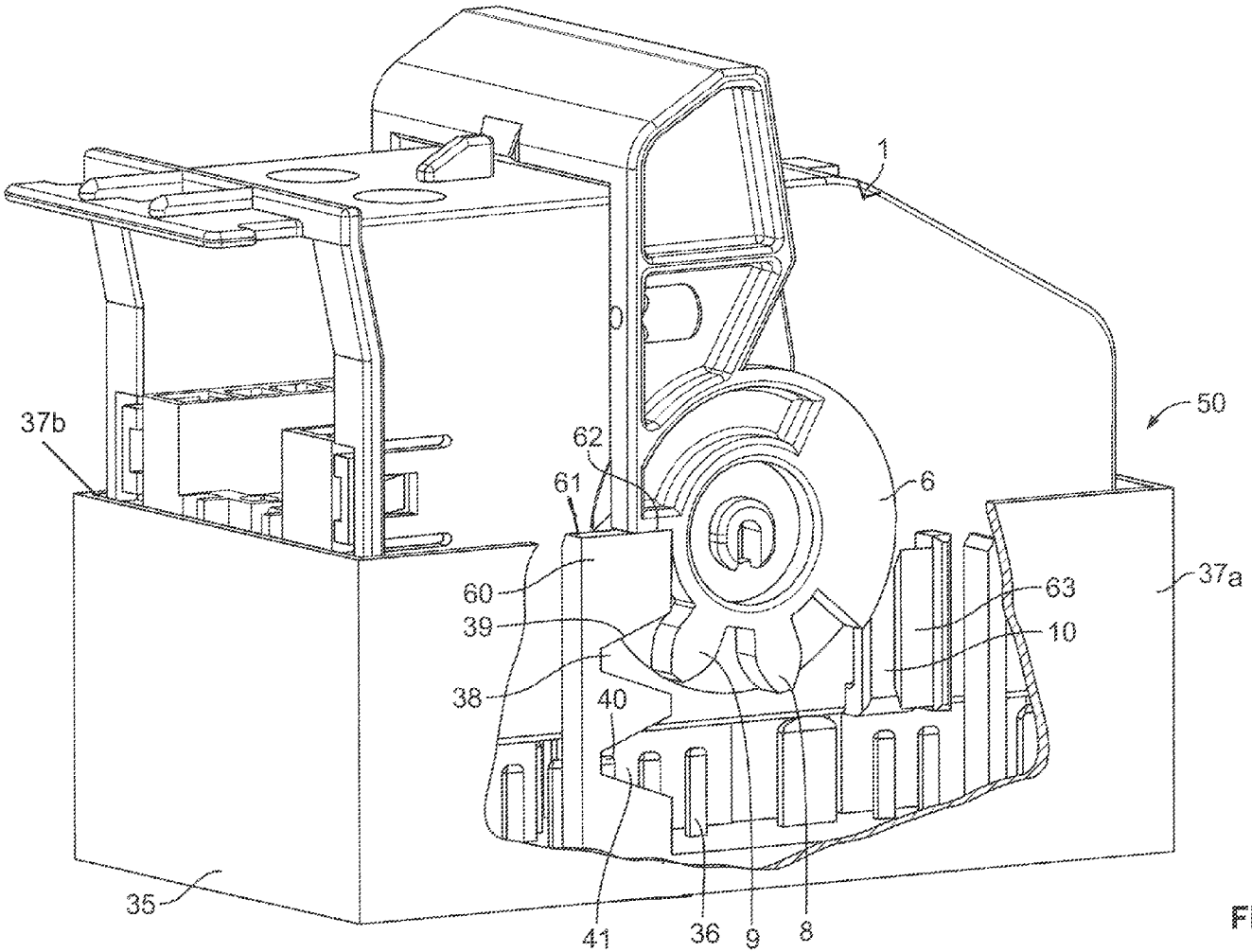
FIG. 6: a partially sectional view of the first and second housings upon the assembly of the two housings.

FIG. 6 shows the first housing 1 and a second housing 35 of the plug-and-socket connector 50, in which the second electrical contacts 36 are arranged in the form of pins, in a partially open representation. The first housing 1 in an assembly position is inserted with the insertion side 17 into an insertion opening in the second housing 35. In so doing, a wall land 60, offset inwards, of a third side wall 37*a* lies with an upper edge 61 against a third contact surface 62 of the first actuating section 6. The second housing 35 has adjoining the wall land 60 on the third side wall 37*a* a third and fourth cut-out 38, 40 with toothed surfaces 39, 41. The first tooth 8 of the first actuating section 6 has a first actuating surface 102 which is engaged with the toothed surface 39 of the third cut-out 38. The second tooth 9 of the first actuating section 6 has a second actuating surface 100 which is engaged with the toothed surface 39 of the third cut-out 38. Upon pivoting the lever 2 in a clockwise direction, the second housing 35 is drawn upwards relative to the first housing 1 by the rotation of the second tooth 9, which is engaged with the toothed surface 39. Furthermore, the fourth cut-out 40 is provided on the inner side of the third side wall 37*a* beneath the third cut-out 38. The fourth cut-out 40 has the additional toothed surface 41, which upon further pivoting of the lever 2 in a clockwise direction comes into engagement with the first tooth 8 and brings about deeper pushing together of the first and the second housing. Partial pieces 63 of the third and fourth side walls 37*a*, 37*b* in this position press the first and second blocking elements 10, 20 inwards, so that the first and the second blocking surface 23, 24 of the first and the second blocking element 10, 20 are no longer in contact with the first and the second contact surface 25, 26 of the first and the second actuating section 6, 22 respectively. Thus pivoting of the lever 2 in a clockwise direction is possible in the assembly position of the first and second housings 1, 35 which is illustrated.

Figure 7:
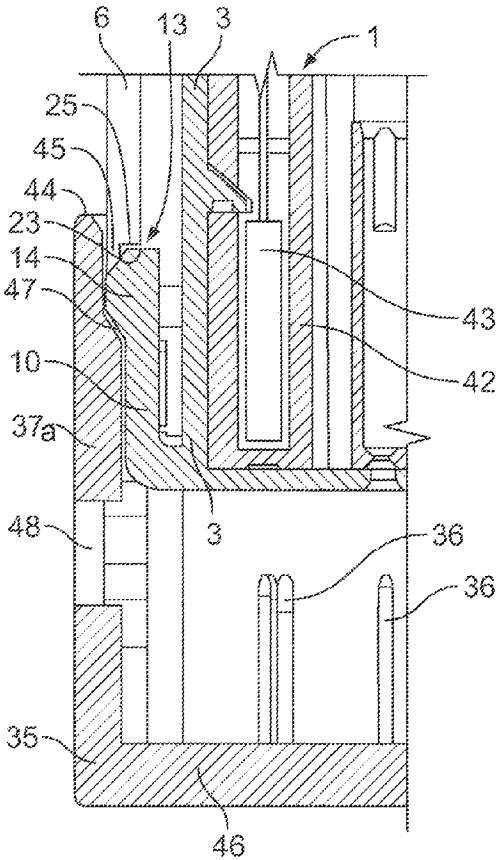
FIG. 7: a partial cross-section through the first and the second housing in a pre-assembly position.

FIG. 7 shows a partial cross-section through the third side wall 37*a* of the second housing 35, the first side wall 3, the blocking element 10, the first actuating section 6 and partial regions of the first and the second housing 1, 35 in a pre-assembly position, in which the two housings are not yet inserted as deeply together as in FIG. 6. FIG. 7 shows contact inserts 42 of the first housing 1 and the first electrical contacts 43. The first blocking element 10 is in a non-loaded starting position, in which the blocking element 10 blocks pivoting of the lever 2. The third side wall 37*a* of the second housing 35 has in the region of the nose 14 of the blocking element 10, starting from an upper lateral edge 44, a groove 45 in which the thickness of the third side wall 37*a* is reduced compared with a lower region. The groove 45 returns to a normal thickness of the third side wall 37*a* via an oblique surface 47 which is arranged in the direction of the blocking element 10. In the position illustrated, the nose 14 of the blocking element 10 is arranged in the groove 45.

Figure 8:
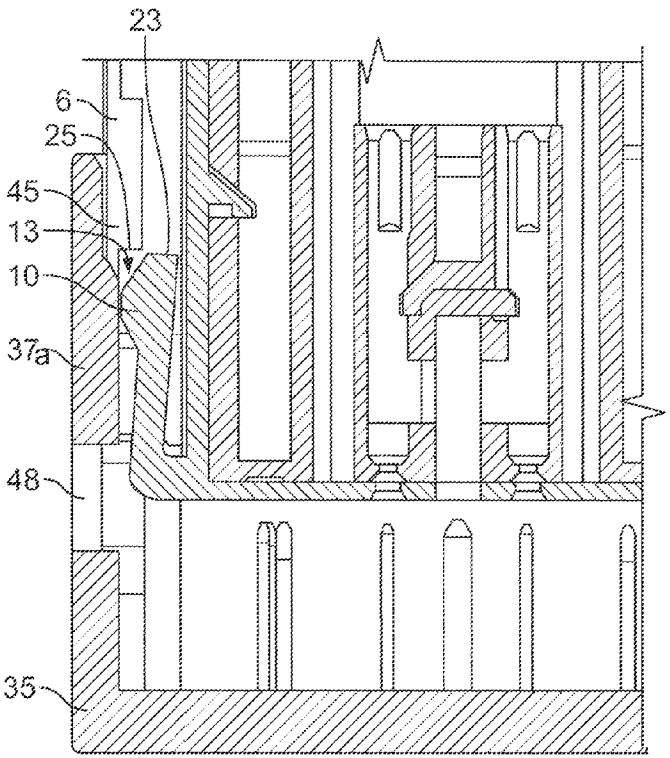
FIG. 8: a partial cross-section through the first and the second housing in the assembly position.

If the first and the second housing, departing from the pre-assembly position illustrated in FIG. 7, are then inserted into one another more deeply into an assembly position, as illustrated in FIGS. 6 and 8, the first blocking element 10 is pressed inwards towards the first side wall 3, since the nose 14 is pushed out of the groove 45, and the nose 14 lies against an inner side of the third side wall 37. This position is shown in FIG. 8. Due to the inward-bending of the blocking element 10, the first blocking surface 23 is moved inwards out of the cut-out 13 and the first contact surface 25 of the first actuating section 6 is released. Thus pivoting of the lever 2 in a clockwise direction is now possible. Thus, by pivoting the lever 2 in a clockwise direction, the lever 2 can now be moved from the pre-engagement position into the end position, with the first and the second housing 1, being assembled from the pre-assembly position into the assembly position by means of the engagement of the first and the second tooth 8, 9 with the third and the fourth cut-out 38, 40. In so doing, the second electrical contacts 36 are inserted into the first housing 1 and are brought into electrical contact with the first electrical contacts 43, which in the embodiment illustrated are formed as female contacts. The outer side of the nose 14, defined by plateau 30, is associated with the oblique surface 47 of the inner sides of the side walls 37 of the second housing 35. The oblique surface 47 and the inner side adjoining it of the third and fourth side walls 372, 37*b* of the second housing 35 represents a release surface for actuating the first and second blocking elements 10, 20.

Figure 9:
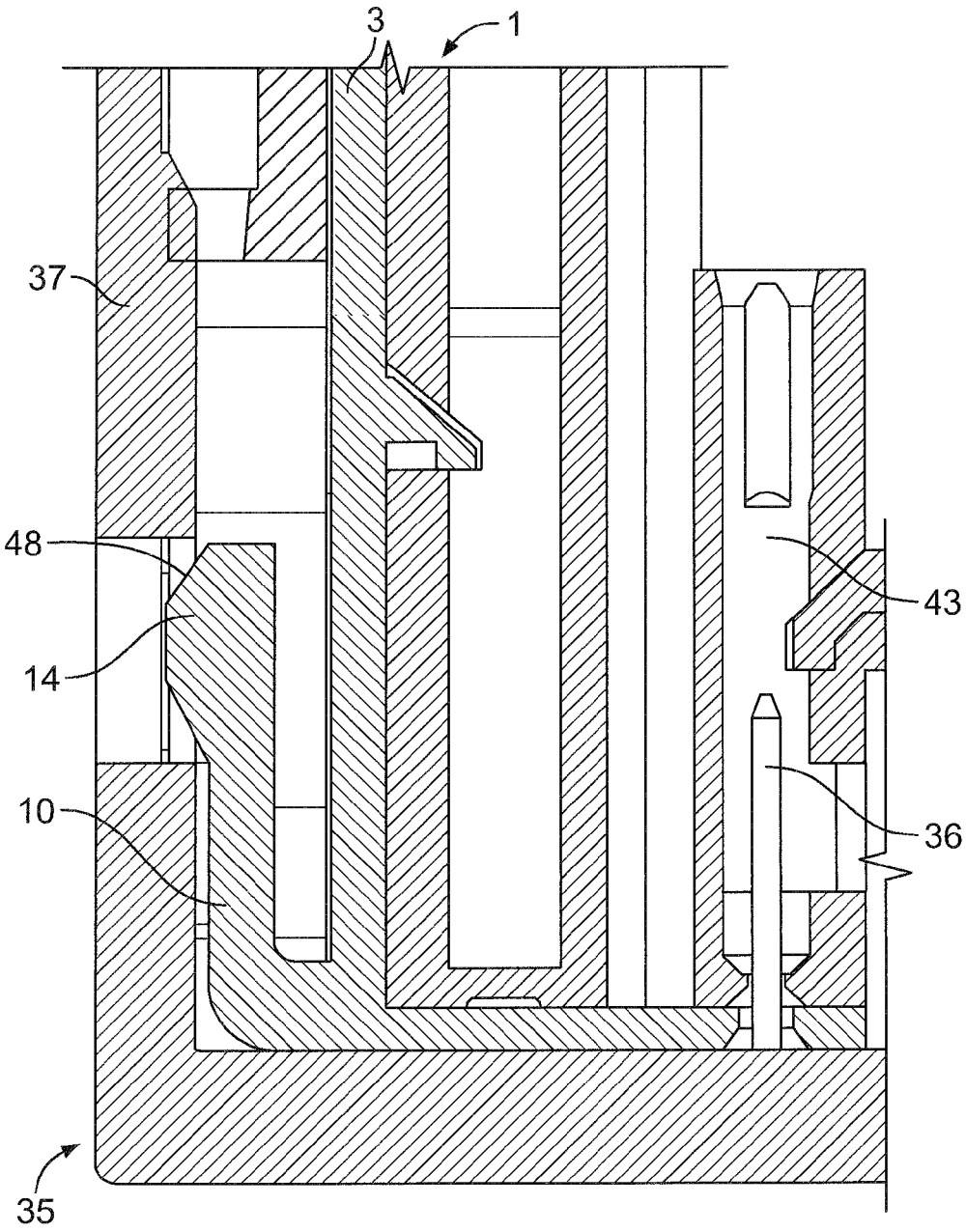
FIG. 9: a partial cross-section through the first and the second housing in the end position.

FIG. 9 shows a partial cross-section through the first and the second housing 1, 35, which are in the end position. In this case, the nose 14 of the blocking element 10 is pivoted into a fifth cut-out 48 in the third side wall 37*a* of the second housing 35. In addition, the blocking section 12 is arranged in the second cut-out 19 in the first actuating section 6. Thus the blocking element 10 is again in a non-loaded starting position.

The second housing 35, just like the first housing 1, is formed mirror-symmetrically to a centre line and has, parallel to and lying opposite the third side wall 37*a* , a fourth side wall 37*b* which is formed mirror-symmetrically to the third side wall 37*a* . Thus the fourth side wall 37*b* also has corresponding cut-outs with toothed surfaces and a corresponding groove with an oblique surface and a further cut-out. The fourth side wall 37*b* cooperates analogously with the second actuating section 22 and the second blocking element 20.

Depending on the embodiment selected, it is possible to dispense with the U-shaped lever 2, and a simple lever 2 with only a single lever arm 5 and a first actuating section 6 can be used.

Furthermore, instead of the blocking element 10, which is in the form of a tongue, the blocking element 10 can also be formed as a blocking element of the corresponding side wall 3, 4. In addition, the first and/or the second actuating section 5, 22 may, instead of the circular-disc form, alternatively be in the form of a partial circular disc or in the form of projecting and recessed sections. In addition, the cut-out 13 and the second cut-out 19 may also be in the form of penetrations in the first or in the second actuating section 6, 22.

In the end position, the blocking section of the first and the second blocking element 10, 20 is arranged in the second cut-out 19 of the first or second actuating section 6, 22 respectively.

In addition, in the end position the lever 2 may be engaged on the holding tongue 18.

Furthermore, depending on the embodiment selected, it is possible to dispense with the recess 33 on the first and on the second blocking element 10, 20. In addition, a different form of a recess may also be selected instead of the nose 14. Furthermore, it is possible to dispense with the nose 14 on the first and the second blocking element 10, 20 if a corresponding recess is provided therefor on the inner side of the third or the fourth side wall 37*a*, 37*b* of the second housing 35, in order to achieve a deflection, in sections, of the first or the second blocking element 10, 20 upon insertion of the first and the second housing from the pre-assembly position into the assembly position.

Depending on the embodiment selected, other forms for the first and the second blocking element 10, 20 with the corresponding first and second blocking surfaces 23, 24, and for the formation of the first and second actuating sections 6, 22 with the first and the second contact surface 25, 26 may also be selected.

The first and the second housing and the lever 2 are preferably made from plastics material. The thickness of the first and the second blocking element 10, 20 is formed such that bending towards the first or the second side wall 3, 4 by pushing together the first and the second housing from the pre-assembly position into the assembly position is possible with low forces, so that free pivoting of the lever 2 from the pre-engagement position into the end position is released.

Depending on the embodiment selected, it is possible to dispense with the fifth cut-outs 48 on the third and on the fourth side wall 37*a*, 37*b* of the second housing 35, and with the second cut-outs 19 on the first or on the second actuating section 6, 22 respectively.

What is claimed is:

1. A plug-and-socket connector, comprising:

a first housing with first electrical contacts; and a second housing with second electrical contacts, the first housing having a lever which is rotatably mounted on the first housing, the second housing having a toothed surface on which the lever can be brought into contact with the toothed surface, with the lever acting with the toothed surface upon pivoting the lever from a pre-engagement position into the end position and drawing the first and the second housing together into the end position in which the first and the second contacts are contacted with each other, the lever having a contact surface, the first housing having a blocking surface on a blocking element, in a pre-assembly position of the first and the second housing in which the two housings are partially inserted into one another, the blocking surface being arranged in a path of movement of the contact surface of the lever from the pre-engagement position towards the end position of the lever, so that pivoting of the lever into the end position is blocked, the second housing having a release surface, upon pushing together the two housings from the pre-assembly position into an assembly position the release surface moving the blocking element with the blocking surface out of the path of movement of the contact surface, so that the lever can be moved from the pre-engagement position into the end position in order to assemble the two housings into the assembly position.

2. The plug-and-socket connector according to claim 1, the blocking element being designed as a flexible tongue which is arranged laterally on a housing wall of the first housing.

3. The plug-and-socket connector according to claim 1, the blocking element having a second actuating surface arranged at least partially at a right-angle to the blocking surface, and the second actuating surface is associated with the release surface for actuating the blocking element.

4. The plug-and-socket connector according to claim 3, the second actuating surface being arranged in the direction of movement of the release surface inclined with increasing coverage to the release surface along the direction of movement of the second housing from the pre-assembly position into the assembly position.

5. The plug-and-socket connector according to claim 1, the contact surface being formed in a cut-out in the lever.

6. The plug-and-socket connector according to claim 1, the lever being rotatably mounted on the first housing in a bearing, with the lever having an at least partially ring-shaped actuating section in the region of the bearing, with a first cut-out being provided on the actuating section, on which cut-out the contact surface is formed.

7. The plug-and-socket connector according to claim 6, the actuating surface being formed on the actuating section, which surface is provided rotatably about the bearing for acting on the toothed surface of the second housing and for drawing the two housings together.

8. The plug-and-socket connector according to claim 6, with a second cut-out being provided on the actuating section, into which at least one of the first cut-out and the second cut-out the blocking surface of the blocking element at least partially projects in the end position of the two housings.

9. The plug-and-socket connector according to claim 1, the release surface being formed on an inner side of the second housing.

10. The plug-and-socket connector according to claim 9, the release surface being formed as a surface arranged inclined in the direction of insertion of the two housings.

11. The plug-and-socket connector according to claim 9, the second housing, at least on the inner side, having at least one cut-out into which the blocking element at least partially projects in the end position of the two housings.

12. A first housing of a plug-and-socket connector, comprising:

first electrical contacts, the first housing having a lever which is rotatably mounted on the first housing, the lever with an actuating surface being able to be brought into contact on a toothed surface of a second housing, the lever being designed to act with the toothed surface upon pivoting from a pre-engagement position into an end position and to draw the first and the second housing together into an assembly position, the lever having a contact surface, the first housing having a blocking surface on a blocking element, the blocking surface being arranged in a path of movement of the contact surface of the lever from the pre-engagement position towards the end position of the lever, so that pivoting of the lever into the end position is blocked, the blocking element being designed to be movable, so that the blocking element with the blocking surface can be moved out of the path of movement of the contact surface by insertion of the second housing, so that the lever can be moved from the pre-engagement position into the end position.

* * * * *